US009718590B2

(12) United States Patent
Dejonge

(10) Patent No.: US 9,718,590 B2
(45) Date of Patent: Aug. 1, 2017

(54) CHILD RESISTANT CAP WITH SAFETY RING AND RING GAP LOCK

(71) Applicant: Stuart W. Dejonge, Lake Mary, FL (US)

(72) Inventor: Stuart W. Dejonge, Lake Mary, FL (US)

( * ) Notice: Subject to any disclaimer, the term of this patent is extended or adjusted under 35 U.S.C. 154(b) by 200 days.

(21) Appl. No.: 14/545,998

(22) Filed: Jul. 17, 2015

(65) Prior Publication Data

US 2017/0015475 A1 Jan. 19, 2017

(51) Int. Cl.
*B65D 50/06* (2006.01)
*B65D 47/06* (2006.01)

(52) U.S. Cl.
CPC ..... *B65D 50/062* (2013.01); *B65D 47/06* (2013.01); *B65D 2203/12* (2013.01); *B65D 2215/04* (2013.01)

(58) Field of Classification Search
CPC ..... B65D 50/062; B65D 2215/04; B65D 2203/12; B65D 47/06
USPC ..... 215/225, 230
See application file for complete search history.

(56) References Cited

U.S. PATENT DOCUMENTS 3,703,974 A 11/1972 Boxer et al.
3,782,578 A 1/1974 Ballin
4,095,718 A 6/1978 Kong
4,361,243 A 11/1982 Virtanen
5,316,162 A * 5/1994 Pierson ..... B65D 50/062 215/206
5,317,796 A 6/1994 Hunter
5,356,043 A 10/1994 Glynn
5,402,900 A 4/1995 Glynn
5,429,255 A 7/1995 Glynn
5,462,181 A 10/1995 Glynn
5,509,580 A 4/1996 Glynn
5,520,305 A * 5/1996 Pierson ..... B65D 83/40 215/206
5,657,905 A 8/1997 Glynn
5,727,704 A 3/1998 Glynn
7,036,672 B2 5/2006 Jaycox
7,111,746 B2 9/2006 Miceli et al.
7,246,715 B2 7/2007 Smith et al.
7,600,648 B2 10/2009 Hamer
7,819,264 B2 10/2010 Brozell et al.
8,584,902 B2 11/2013 Dejonge
2014/0360969 A1 12/2014 Ackerman

* cited by examiner

*Primary Examiner* — James N Smalley

(57) ABSTRACT

A child resistant cap includes: (a) a main closure base; (b) an outer ring unit that functions as a safety collar; (c) a dispensing mechanism on the base; (d) an overcap. The base attaches to a top dispensing container and the horizontally rotatable ring unit is attached to the base. Alternatively, the outer ring unit is fixedly attached to the container. The overcap has protrusions and the ring has corresponding cut outs. There is a ring cut out gap lock that prevents at least one protrusion from passing through a cut out gap, unless it is moved to a release position after alignment of the ring unit and overcap.

20 Claims, 8 Drawing Sheets

CHILD RESISTANT CAP WITH SAFETY RING AND RING GAP LOCK

BACKGROUND OF INVENTION a. Field of Invention

The present invention relates to child resistant caps, and more particularly to overcaps with safety rings for tubes, bottles and other capped containers. The present invention child resistant safety caps include improvements that enhance the safety of prior art devices by inclusion of a collar gap lock that must be released, in addition to other safety steps, before the cap can be removed from the container.

b. Description of Related Art

The following patents are representative of the field pertaining to the present invention:

U.S. Pat. No. 3,703,974 to Leo Boxer and Robert Boxer describes a safety cap and container combination wherein the container mouth includes a plurality of spaced ribs or flanges, each having a differently located, notched out passageway over which a cap member having at least one projecting internal lug is positioned in a single movement to close the container. In one form of the invention, a bead at the rim of the container mouth may be provided to mate with an internal groove in the cap member to seal tightly the cap member to the container. In order to remove the cap member, it is moved partially away from the container to disengage the bead from the groove and the lug member is then positioned and aligned with each slot and advanced therethrough in successive fashion to open the mouth of the container.

U.S. Pat. No. 3,782,578 to Gene Bailin sets forth a novel disposable closure. The device includes an opener for opening a closure cap along a score line around the base of an annular channel without piercing the cap. It includes a collar which rotatably and slidably engages the cap and includes a peripheral wall provided with circumferentially spaced depending arcuate teeth of greater thickness than the channel and stop elements which limit the downward movement of the device on the cap. The device is pressed downwardly and rotated so that the teeth wedge between and spread the channel walls to sever the closure along the full length of the score line. The piercing of the channel by the teeth is prevented by the stop elements.

U.S. Pat. No. 4,095,718 to Cheung Tung Kong describes a convertible safety cap. A cap is provided for closing a container having a locking portion for use in a precautionary arrangement to prevent children from obtaining access into the container. The cap is convertible so as to cooperate with such a container to provide not only such a precautionary arrangement but also an alternative easy opening arrangement. The invention includes a cap, an annular disk and a locking rim with notches through which tabs on the cap may pass.

U.S. Pat. No. 4,361,243 to Risto Virtinen describes a closing means for a container, tube or the like. This device is a closing means for a nozzle that is fixably mounting on a container or for a tube or the like. The closing means is openable when turned into a predetermined position that is indicated by indicators provided on the closing means and on the container. It is settable diametrically opposite to each other, and characterized in that the lower rim of the closing means or the upper rim of the container is provided with a separate background ring extending at least partially behind the indicator of the closing means and the indicator of the container.

U.S. Pat. No. 5,317,796 to Hunter describes packaging having a combination lock closure which is rendered child resistant in a manner that maintains ease of adult use and economy of manufacture while providing adequate protection of child health. The technique comprises the steps of selecting an appropriate child resistance effectiveness, selecting an appropriate older adult use effectiveness, determining a probability of random opening that correlates with the selected child resistances effectiveness and provides at least the selected older adult use effectiveness, and configuring the combination lock closure to present to the package user said probability of random opening. Configuring the closure may include providing a plurality of tumblers, only one of which is accessible to manual manipulation.

U.S. Pat. No. 5,356,043 to Glynn describes a spray dispenser device closure. It includes a main closure base for attachment to a container, an outer ring, a spray mechanism attached to the base and an overcap. The main closure base has a top portion with a circular horizontal track thereon for attachment with an outer ring. The outer ring has a circular inside wall with a horizontal track thereon for attachment to the track of the base so as to connect them in such a way as to be horizontally and freely rotatable thereabout. The outer ring has a top with an inwardly biased ledge for retaining an overcap and has at least one cut out on the ledge to permit an overcap to be inserted and removed from the outer ring. The spray mechanism is attached to the top of the base and extends therethrough for insertion into a container. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided.

U.S. Pat. No. 5,402,900 to Glynn describes the present invention which is directed to a child resistant snap cap container device which includes a container, a collar ring, a snap cap and a spring. The container has a neck with a lower retainer bead and an upper retainer bead thereon and has at least one stop located below the lower retainer bead and at least one derailer lift located above the lower retainer. The collar ring is fitted onto the neck and has undercut ledges located on its inside so as to fit under the lower retainer bead of the neck and in horizontal alignment with the stop(s). The snap cap has a snap lip and has derailers located on its inside wall. It is hinged to the collar ring. The cap is adapted to fit onto the neck with the derailers being located below the upper retainer bead. There is at least one spring located between the ring and the shoulder of the container which biases the ring upwardly such that the container cannot be opened merely by rotation but must be pushed down and rotated to open.

U.S. Pat. No. 5,429,255 to Glynn describes a dispenser closure, having a main closure base for attachment to a container, an outer ring and a push-pull dispenser mechanism attached to the base. The main closure base has a top portion with a circular horizontal track thereon for attachment with an outer ring and the outer ring has a corresponding circular inside wall horizontal track. They are connected so as to be freely horizontally rotatable thereabout, but otherwise permanently connected to one another. The outer ring has a top with an inwardly biased ledge for retaining a push-pull sleeve of the push-pull mechanism, and has a downwardly extended aspect to the ledge to retain the sleeve closed, and at least one cut out on the ledge to permit the sleeve to be pulled up to an open position. The sleeve has a circular bottom for inserting into the outer ring and over a push-pull stem of the push-pull mechanism. The bottom of the sleeve has at least one protrusion with geometry of adequate size to freely move up the cut out of the ledge of the outer ring when aligned therewith.

U.S. Pat. No. 5,462,181 to Glynn describes dispenser closure includes a main closure base attachable to a container, an outer ring, an inner cap removably attached to the base and an overcap. The main closure base has a top portion with a circular horizontal track thereon for attachment with an outer ring. The outer ring has a circular inside wall with a horizontal track thereon for attachment to the track of the base so as to connect them in such a way as to be horizontally and freely rotatable thereabout. The outer ring has a top with an inwardly biased ledge for retaining an overcap and has at least one cut out on the ledge to permit an overcap to be inserted and removed from the outer ring. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided.

U.S. Pat. No. 5,509,580 to Glynn describes a spray dispenser device closure. It includes a main closure base for attachment to a container, an outer ring, a spray mechanism attached to the base and an overcap. The main closure base has a top portion with a circular horizontal track thereon for attachment with an outer ring. The outer ring has a circular inside wall with a horizontal track thereon for attachment to the track of the base so as to connect them in such a way as to be horizontally and freely rotatable thereabout. The outer ring has a top with an outwardly biased ledge for retaining an overcap and has at least one cut out on the ledge to permit an overcap to be inserted and removed from the outer ring. The spray mechanism is attached to the top of the base and extends therethrough for insertion into a container. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out.

U.S. Pat. No. 5,657,905 to Glynn describes a spray dispenser device closure. It includes a main closure base for attachment to a container, an outer ring, a spray mechanism attached to the base, a semi-flexible tether, and an overcap. The main closure base has a top portion with a circular horizontal track thereon for attachment with an outer ring. The outer ring has a circular inside wall with a horizontal track thereon for attachment to the track of the base so as to connect them in such a way as to be horizontally and freely rotatable thereabout. The outer ring has a top with an outwardly or, alternatively, an inwardly biased ledge for retaining an overcap and has at least one cut out on the ledge to permit an overcap to be inserted and removed from the outer ring. The overcap has a circular bottom adapted to be inserted into or, alternatively, onto the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out. The semi-flexible tether has a rest position and a twisted position and has a first end connected to the outer ring and a second end connected to the overcap.

U.S. Pat. No. 5,727,704 to Glynn describes a container closure device, which includes a container, a collar ring and a cap. The container has a neck, an open top and a horizontal retainer track thereon for affixing a collar ring thereto. A collar ring affixed to a track of the container has a plurality of cut outs on a ledge to permit a cap to be inserted and removed from the collar ring. The cap has a plurality of bosses which correspond to and are sized to freely move through the cut outs of the ledge of the collar ring and, when the cap is so inserted and rotated, of adequate size to cause frictional engagement and to cause simultaneous rotation of the cap and the collar ring and to prevent removal of the cap from the collar ring, except when the cap and the collar ring are held separately and are rotated relative to one another such that the bosses and the cut outs are in alignment for lift up removal of the cap from the collar ring. Corresponding bosses and cut outs have different lengths and depths so that one boss cannot slip through a non-matched cut out.

U.S. Pat. No. 7,036,672 B2 to Jaycox describes a packaging system that includes an elongate vessel and a lid. The vessel includes a bottom wall, a top surface, and a cylindrical body between the top surface and bottom wall. The body includes an outer surface, a tapered inner surface, and a vertical portion. The vertical portion extends between the tapered inner surface and the top surface. The vessel further includes a plurality of locking tabs formed on the outer surface. The lid includes a cylindrical body, an interior perimeter and an inner surface, and an inner sealing ring extending from the inner surface and configured to engage and seal against the vertical portion of the elongate vessel. The lid also includes an outer sealing ring extending down from the inner surface and out from the interior perimeter, a plurality of tab receptacles positioned within the lid cylindrical body, and a plurality of notches within the cylindrical body positioned between the plurality of tab receptacles. The tab receptacles are configured to receive the plurality of locking tabs.

U.S. Pat. No. 7,111,746 B2 to Mitolli et al. describes a shellable, positively lockable, child resistant closure and container that includes a pair of nested inner and outer caps designed to be purposefully shellable for use in its non-child resistant mode. The inner cap is coaxially positioned and nested within the outer cap such that a row of angular abutments of the inner cap engage a row of angular abutments of the outer cap upon rotation of the outer cap in a closing direction, and upon rotation of the outer cap in an opening direction, without a concomitant axial force, the respective angular abutments cam over and past each other to prevent rotation of the inner cap. Additionally, the inner cap contains a positive locking device for engagement with a complementary locking device on the neck of the container.

U.S. Pat. No. 7,246,715 B2 to Smith et al. describes a reclosable lid 310 for a container holding a flowable substance that has a cover 312 and a rotatable element 50 rotatably supported by the cover 312. The cover 312 has an opening 28 and a slot 30 located in a top wall 14 of the cover 312. The cover 312 also has a tab 323 extending outward from a portion of the cover 312. The rotatable element 50 has at least one aperture 78 and an actuator 54 that is accessible through the slot 30. The element 50 is moveable by manipulation of the actuator 54 between a first position wherein the aperture 78 is misaligned with the opening 28, and a second position wherein the aperture 78 is aligned with the opening 28. The cover 312 has at least one support member 102 extending radially inward from an inner surface 100 of the cover 312, wherein the support member 102 rotatably supports the element 50.

U.S. Pat. No. 7,600,648 B2 to Hamer describes a locking cap for a container that has a combination lock built into the top. Two or more thumbwheels with numbers or letters are mounted beneath the top surface of the cap or gung plugs. The thumb wheels have through holes corresponding to the numbers or letters. One or more pins are slidably mounted in the cap. The pins are locked by the thumb wheels unless the through holes are in alignment. The pins either project through holes in the container or abut inwardly, projecting portions with the top of the container to prevent turning of the cap unless the pins are retracted. Combinations of numbers or letters can be preset at manufacture, or selected at or after sale, using plugs to fill selected through holes.

U.S. Pat. No. 7,819,264 B2 to Brozell et al. describes a child-resistant package which includes a container having a finish with an open end, external thread, stop lug projecting radially outwardly from the finish, and a closure having a base wall, a skirt with internal thread for engagement with the thread on the container finish, spring element and pair of internal lugs on the skirt and extending radially inwardly from the skirt. Each pair of internal lugs includes a first lug that cooperates with the stop lug on the container finish to prevent unthreading of the closure from the finish absent pressure on the closure against the spring element to push the first lug beneath the corresponding stop lug on the container finish, and a second lug circumferentially spaced from the first lug that cooperates with the stop lug to prevent over tightening of the closure on the finish.

U.S. Pat. No. 8,584,902 B2 to DeJonge describes a child resistant cap with a U-channel safety component that includes an inner and an outer member. The inner member has sidewalls with two horizontal tracks, being an upper and a lower track. There in a top horizontal flange with breaks to permit movement of outer member inwardly projecting lugs therethrough, and a central horizontal flange with breaks to permit movement of inwardly projecting lugs from the lower track upwardly past the central horizontal break, past the upper track, and through the breaks of the upper track top horizontal flange. There are vertical stops that prevent the lugs from entering the break when in the upper track, and one stop adjacent one break on the lower track to permit lugs to enter the break when in the lower track. A user rotates the outer member to a position for movement to the lower track, rotates to a stop, and lists to open.

United States Patent Application Publication No. 2014/0360969 to Ackerman et al. describes a one component or embodiment of a locking medical container that is the quality of the material used. The sterile non-chemically reactive polypropylene container is suitable for most medical applications. The lock and all its components are made strong to secure the medications from all but the prescribed user. This is done by using a structural method that joins the parts in such a manner as to produce a solid locking unit. The snap in capability of some of the parts used remove manufacture difficulties that are found in other locking devices. This unit when completed is sealed, sterile and very strong. The user simply rotates the tumbler and removes the cavity obstruction to gain access to the contents of the container.

Notwithstanding the prior art, the present invention is neither taught nor rendered obvious thereby.

SUMMARY OF INVENTION

The present invention relates to a child resistant cap with safety ring and ring gap lock for direct attachment to a container having a rim of greater diameter than its neck, which comprises: a) an outer ring unit having a circular wall with a horizontal track thereon for attachment to the rim of a container having a top dispenser and having a rim of greater diameter than its adjacent neck, so as to connect said outer ring unit to said rim so as to be horizontally fixed thereon, said outer ring unit having a top with an outwardly biased ledge to permit an overcap to be inserted onto and removed from said outer ring unit, and said ledge having at least one cut out gap thereon; b) at least one moveable ring gap lock located in said at least one cut out gap, said ring gap lock having a first position, being a locked position blocking said at least one cut out gap, and having a second position, being a release position opening said at least one cut out gap and, one of said outer ring unit and said at least one moveable ring gap having a first alignment indicia thereon; c) an overcap having a circular bottom adapted to be inserted over said top dispenser of said container and onto said outer ring unit, said circular bottom having a second alignment indicia, and said overcap having at least two protrusions thereon, at least one of which has a geometry of adequate size to freely move through said at least one cut out gap when said gap lock is in its release position, and of adequate size and geometry to prevent removal of said overcap from said outer ring when said gap lock is in said locked position; and d) further wherein said outer ring unit ledge has an underside and said at least two protrusions of said overcap have a top, wherein the underside of said ledge prevents the top of said at least two protrusions from passing over said ledge, except when in the gap position when said lock is moved to said release position to permit at least one of said at least two protrusions to pass therethrough. When one of said outer ring unit and said overcap is held, and the other of said outer ring unit and said overcap is rotated to place said first alignment indicia and said second alignment indicia in alignment with one another, and then said gap lock is moved into said release position, said overcap may be removed from said outer ring unit to uncover said top dispenser of said container for use.

In some embodiments of the present invention child resistant cap with safety ring and ring gap lock, the at least one cut out gap is a plurality of cut out gaps.

In some embodiments of the present invention child resistant cap with safety ring and ring gap lock, the child resistant cap further includes an interloper attachment means for positioning between said outer ring unit and a container neck to which it is to be attached, and has a container attachment means selected from the group consisting of threading, snap-lock and spring lock.

In some embodiments of the present invention child resistant cap with safety ring and ring gap lock, the child resistant cap further has at least two speed bumps located below said outwardly biased ledge adapted to reduce for horizontal movement of an overcap until minor frictional engagement is surpassed by minimal force.

In some embodiments of the present invention child resistant cap with safety ring and ring gap lock, the ring gap lock is selected from the group consisting of a slide lock, a hinge lock and a swing lock.

In some embodiments of the present invention child resistant cap with safety ring and ring gap lock, the ring gap lock is a hinged ring gap lock that may be pressed to move it from said locked position to said release position.

In some embodiments of the present invention child resistant cap with safety ring and ring gap lock, there are at least three protrusions, said protrusions being spaced apart from one another.

In some embodiments of the present invention child resistant cap with safety ring and ring gap lock, the underside of said ledge and said top of said at least one protrusion have non-smooth topographies to enhance said frictional contact.

In some embodiments of the present invention child resistant cap with safety ring and ring gap lock, at least one of said ledge and said at least two protrusions are flexible so as to permit insertion of said overcap onto said outer ring without alignment of said at least two protrusions and said at last two cut out gaps, and are upwardly inflexible so as to prevent removal of said overcap from said outer ring, except when there is alignment and said gap lock is in its release position.

In some embodiments of the present invention child resistant cap with safety ring and ring gap lock, there are two ring gap locks at two different gaps.

In some other present invention preferred embodiments, a child resistant cap with safety ring and ring gap lock for direct attachment to a container having a rim of greater diameter than its neck, which includes: a) an outer ring unit having a circular inside wall with a horizontal track thereon for attachment to the rim of a container having a top dispenser and having a rim of greater diameter than its adjacent neck, so as to connect said outer ring unit to said rim so as to be horizontally and freely rotatable thereabout, said outer ring unit having a top with an outwardly biased ledge to permit an overcap to be inserted onto and removed from said outer ring unit, and said ledge having at least one cut out gap thereon; b) at least one moveable ring gap lock located in said at least one cut out gap, said ring gap lock having a first position, being a locked position blocking said at least one cut out gap, and having a second position, being a release position opening said at least one cut out gap and, one of said outer ring unit and said at least one moveable ring gap having a first alignment indicia thereon; c) an overcap having a circular bottom adapted to be inserted over said top dispenser of said container and onto said outer ring unit, said circular bottom having a second alignment indicia, and said overcap having at least two protrusions thereon, at least one of which has a geometry of adequate size to freely move through said at least one cut out gap when said gap lock is in its release position, and of adequate size and geometry to prevent removal of said overcap from said outer ring when said gap lock is in said locked position; d) further wherein said outer ring unit ledge has an underside and said at least two protrusions of said overcap has a top, wherein the underside of said ledge and the top of said at least two protrusions are in frictional contact with one another when said overcap is inserted into said outer ring unit such that when one of said outer ring unit and said overcap are rotated, the other of said outer ring unit and said overcap rotates therewith, and wherein said frictional contact may be overcome manually by holding one of said outer ring unit and said overcap and rotating the other of said outer ring unit and said overcap relative to one another. When one of said outer ring unit and said overcap is held, and the other of said outer ring unit, and said overcap is rotated to place said first alignment indicia and said second alignment indicia in alignment with one another, and then said gap lock is moved into said release position, said overcap may be removed from said outer ring unit to uncover said top dispenser of said container for use. In this version of the present invention, the outer ring unit is constructed to be rotatable around the rim of the container and frictionally engageable with the overcap. In other words, it rotates with the covercap until one is held and the other is rotated, so as to align the indicia. These embodiments may have any or all of the features set forth in previous paragraphs above. Additionally, in some of these rotatable outer ring unit embodiments, there are at least two speed bumps located below said outwardly biased ledge adapted to reduce for horizontal movement of an overcap until minor frictional engagement is surpassed by minimal force.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
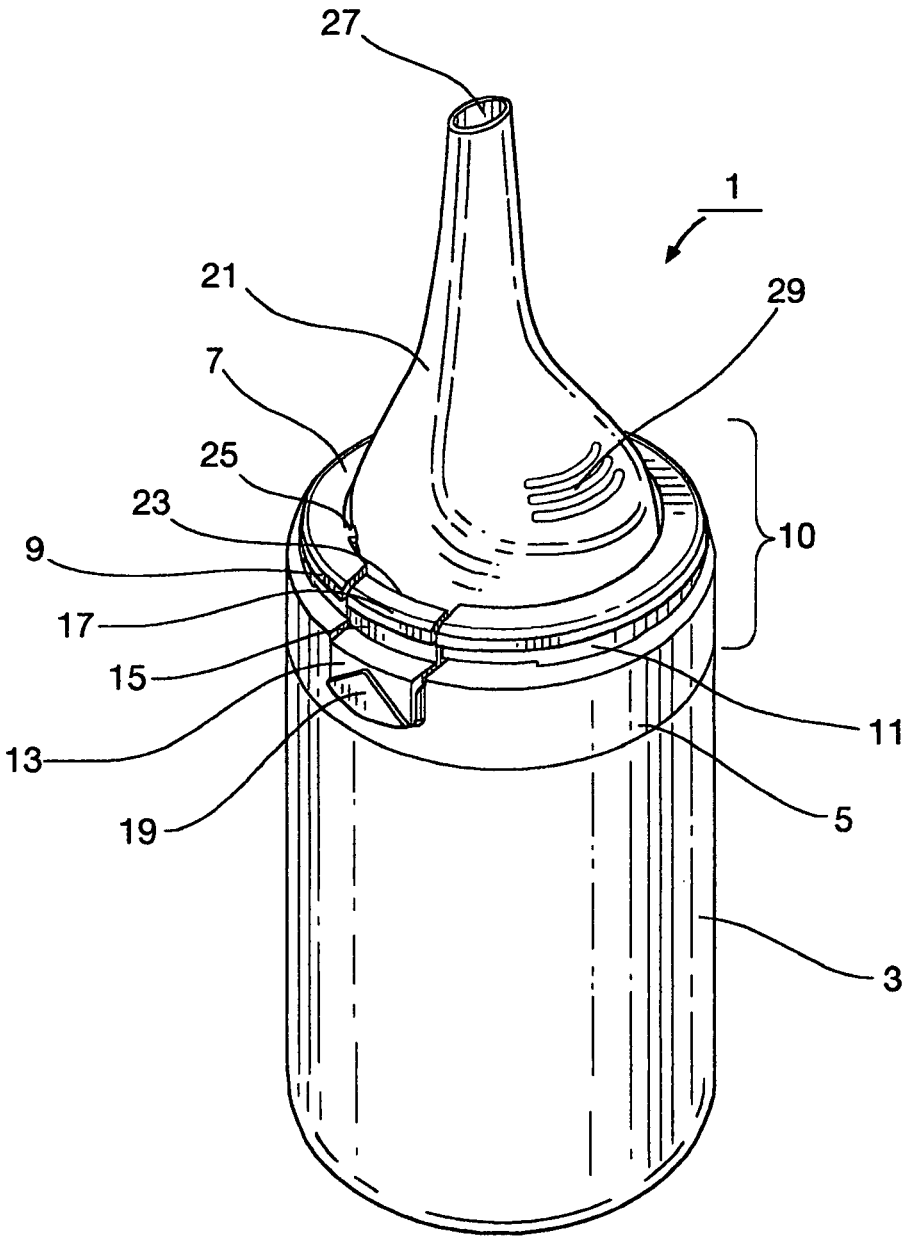
FIG. 1 is an oblique drawing of one embodiment of the present invention child resistant safety cap on a container, and includes the safety ring and ring gap lock, with the overcap removed.

Referring now in detail to the drawings wherein like reference numerals designate corresponding parts throughout the several views, various embodiments of the present invention are shown.

FIG. 1 is an oblique drawing of one embodiment of the present invention child resistant safety cap 1 on a container 3, with the overcap removed. Safety cap 1 includes an outer ring unit 10 and a top dispenser 21. Here, main closure base 5 of outer ring unit 10 is shown attached to container 3. This attachment may be a force fit snap on attachment, a locking ratchet mechanism, a lock thread attachment, or any other known attachment mechanism. Base 5 includes a circular recess 11 and an outwardly biased ledge 9. There is a gap that is cut out from ledge 9, shown as gap 23. There is also a ring gap lock 13 positioned in cut out gap 23 that has a first locked position, as shown here. Also, ring gap lock 13 has an arcuate recess 15 and an outwardly biased ledge 17 that mimic same components (recess and ledge) of the other ring unit 10.

Ring gap lock 13 is movable within cut out gap 23 and it includes alignment indicia 19. When an overcap is snapped onto ledge 9, it cannot be removed unless two steps are taken—first, the overcap needs to aligned with alignment indicia 19, and, second, ring gap lock 13 needs to be depressed. Thus, a user may press at indicia 19 so as to move ledge 17 toward center to an unlock position for overcap release.

Top dispenser 21 has an internal connection to the nozzle tube of container 3, which also connects to dispensing nozzle 27. Top dispenser 21 is moveably and hingedly connected to top 7 of ledge 9 at hinge 25. When a user presses grips 29, top dispenser 21 tilts and content is released from container 3 at dispensing nozzle 27. While the dispenser 21 is with a pressurized container and dispenser nozzle, it could alternatively be a push-pull dispenser, a screw cap, a pump dispenser or any other dispenser known. The purpose of the present invention is to create a strong child resistant feature that requires two distinct steps for removal, yet doesn't require significant strength. The two steps are: rotate to align, and release lock to remove overcap.

In any present invention embodiment, the container to which the child resistant safety cap is attached may have any dispensable flowable material such as liquid, sprayable liquid, gel, foam or the like. The dispensing component of the container may generally be referred to as a nozzle and could be any type of known dispenser, as mentioned. For example, a spray nozzle that is push activated or otherwise activated, a push-pull dispenser, a screw cap and open neck or a tilt dispenser could be used. The main container base may simply have an opening for the nozzle or include functional parts that may connect to or otherwise come and contact with a nozzle or nozzle activator. In some preferred embodiments of the present invention child resistant safety cap, the nozzle and the outer ring unit may be separately created and in other embodiments may be integrally formed, such as from a single mold. The present invention outer ring unit is attached to the container by known conventional means and may include crimping, heat sealing, force fitting, irreversible threading or any other known attachment means.

Figure 2:
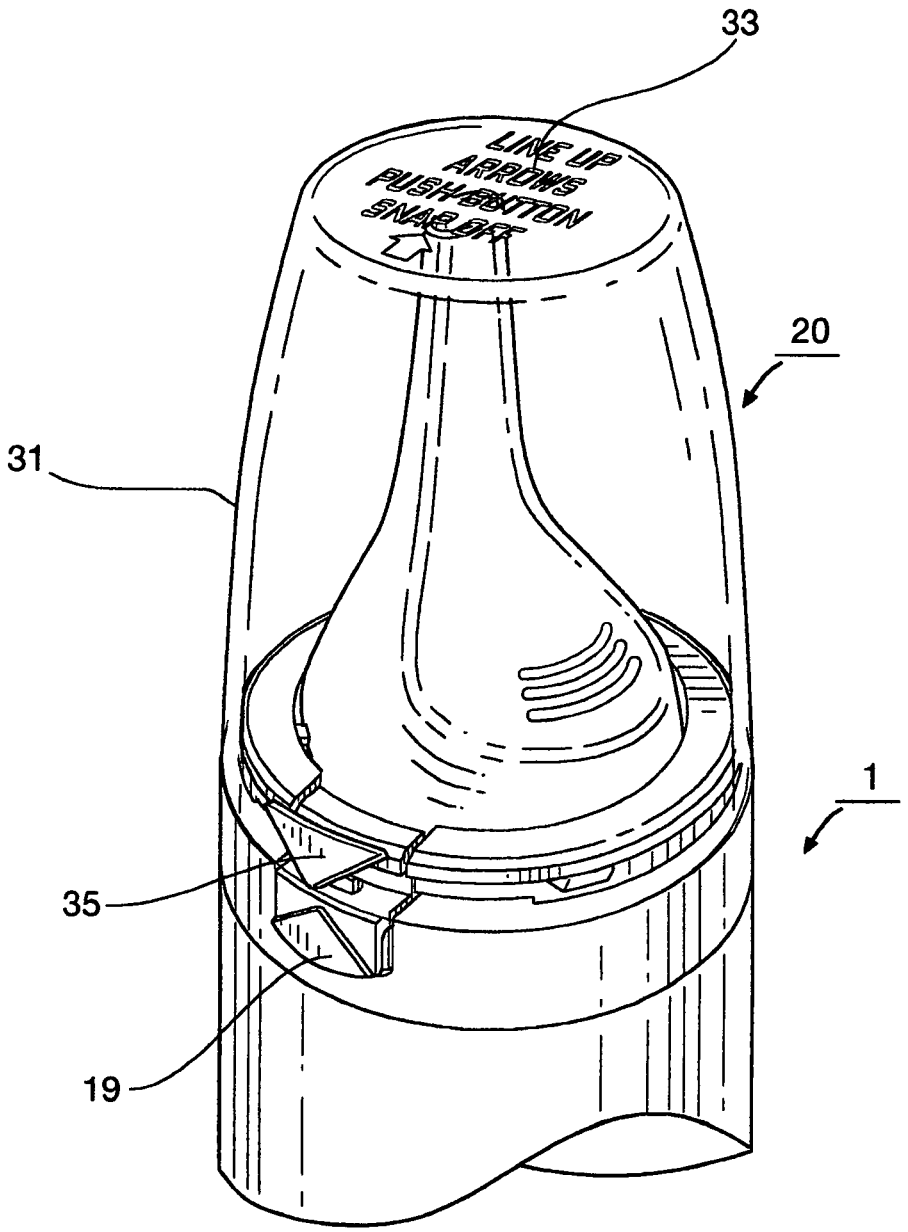
FIG. 2 shows an oblique view of the present invention child resistant safety cap as shown in FIG. 1, but with the overcap in place.
Figure 3:
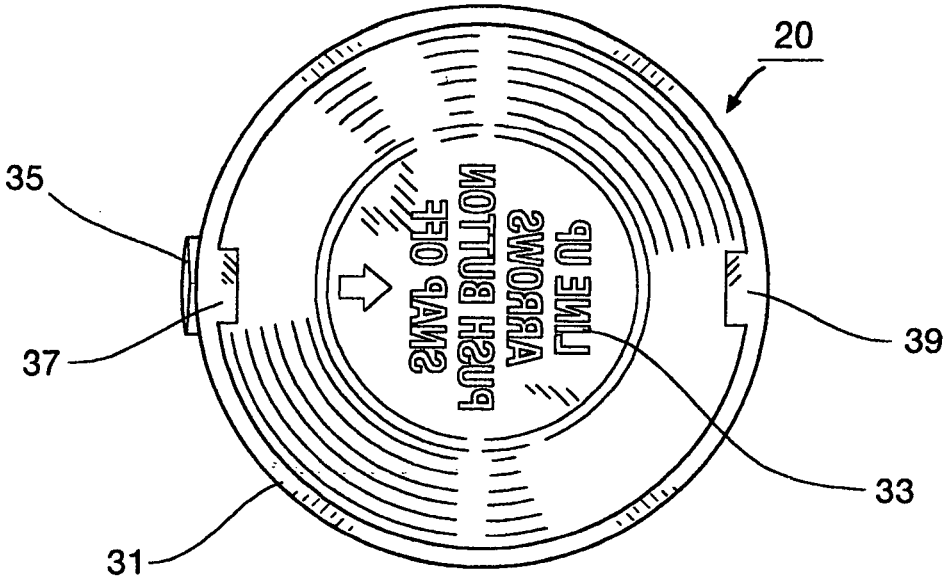
FIG. 3 shows a bottom view of the overcap used in a present invention child resistant safety cap shown in FIGS. 1 and 2.

FIG. 2 shows an oblique view of the present invention child resistant safety cap as shown in FIG. 1, but with the overcap in place and FIG. 3 shows a bottom view of only overcap 20. The reference numerals that are the same in FIGS. 1 and 2 and 3, and relate to the same components in all Figures. This is likewise true of FIG. 4, described further below.

Figure 4:
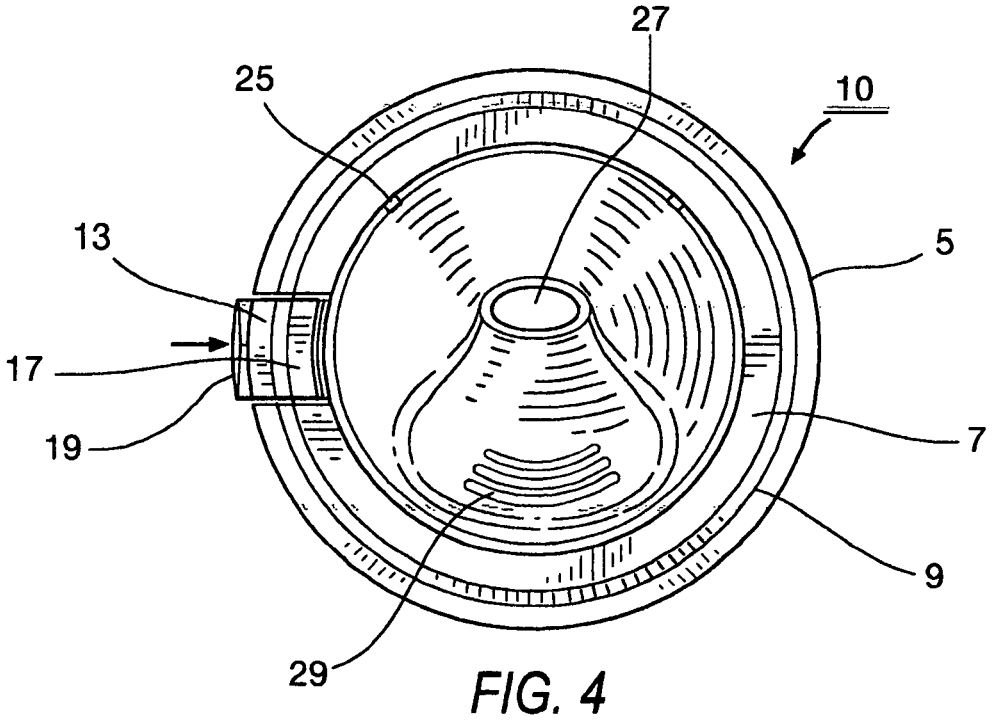
FIG. 4 shows a top view of a present invention child resistant safety cap, including the ring gap lock, that is shown in FIGS. 1 and 2.

Overcap 20 has sidewall 31, with indicia 35 thereon for alignment with ring unit indicia 19, as shown. It has an open bottom, and strategically positioned and sized inwardly projecting protrusions, shown in FIG. 3 as protrusions 37 and 39. While in FIG. 2 it is in the "firing position", i.e., properly aligned by the indicia positioning, it can still not be opened unless ring gap lock 13 is moved to the release position. FIG. 4 shows a top view of the FIG. 1 outer ring unit 10 with identical components identically numbered. Taking all of FIGS. 1, 2, 3 and 4 collectively, it can be seen that the overcap 20 may be snapped onto ledge 9 in any position and it cannot be removed until proper alignment, as represented by FIG. 2, and then pressing or otherwise moving the lock into the release position, followed by lifting of the overcap. (Note that the overcap 20 has two internal protrusions yet there is only one cut out gap in ring unit 10. This is functional, as once one protrusion is released through the unlocked gap and the overcap is tilted, the second protrusion will slide out from the ledge of the ring unit.

Figure 5:
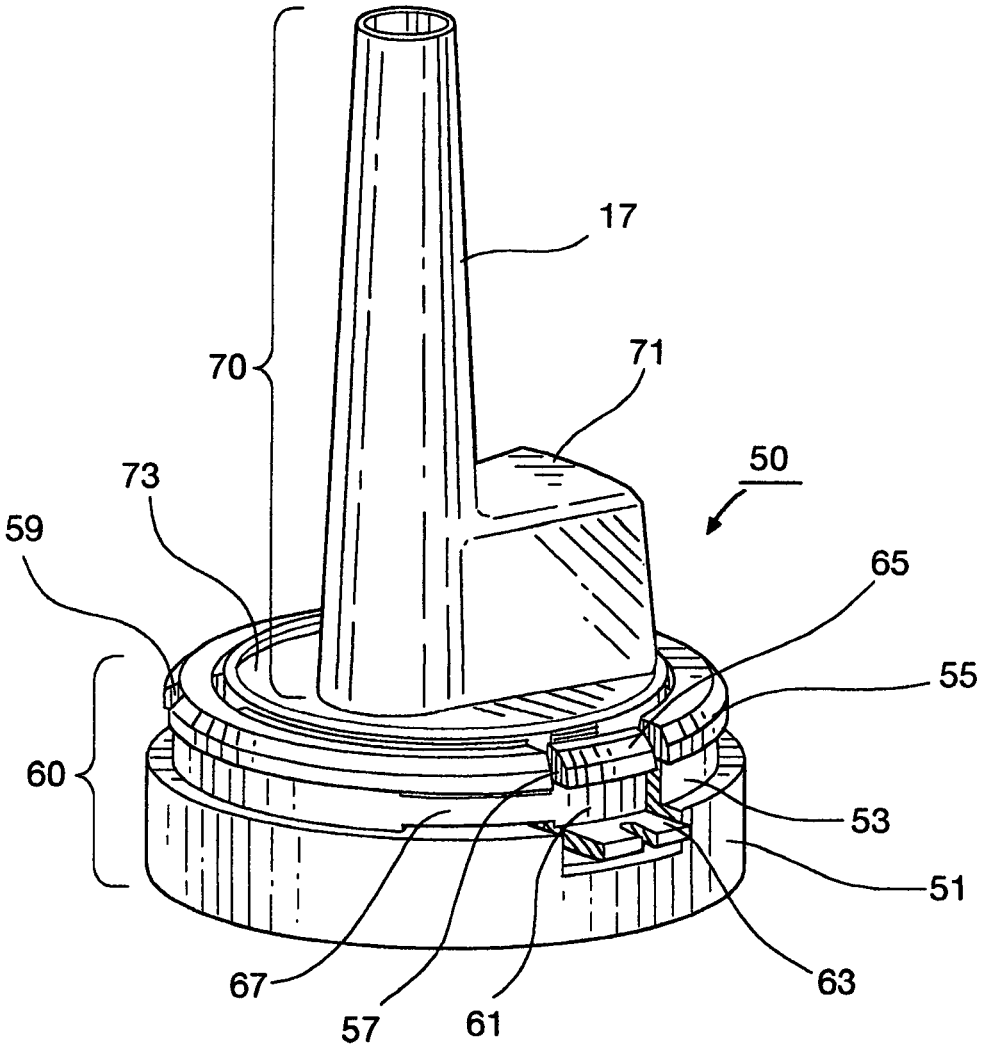
FIG. 5 shows a side oblique view of an alternative embodiment outer ring unit for a present invention child resistant cap outer ring unit with two different cutout gaps, one with and one without a ring gap lock.
Figure 6:
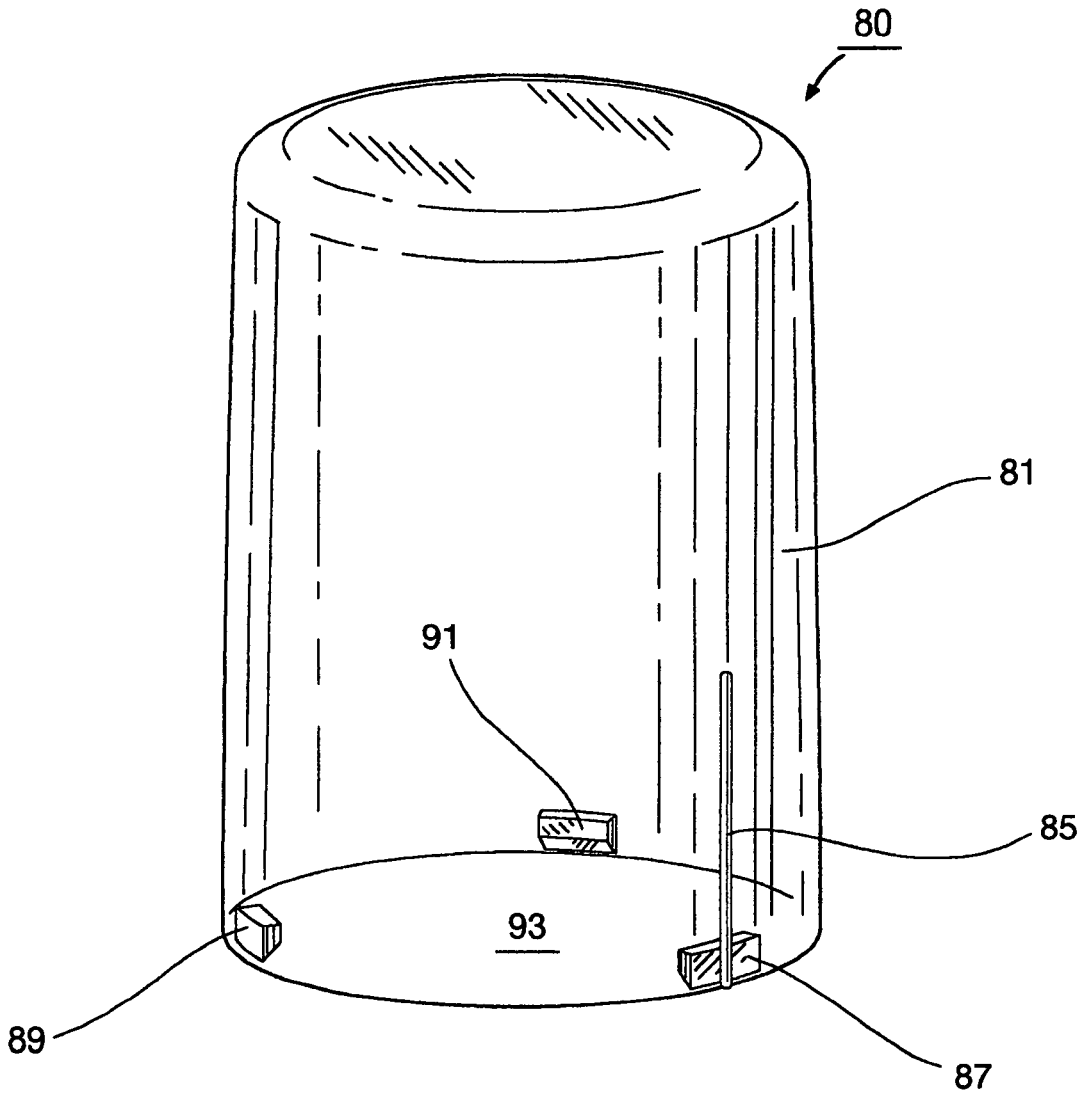
FIG. 6 shows a side oblique view of an overcap for use with the alternative embodiment outer ring unit of FIG. 5.

FIG. 5 shows a side oblique view of an alternative embodiment outer ring unit for a present invention child resistant cap outer ring unit with two different cutout gaps, one with and one without a ring gap lock and FIG. 6 side oblique view of an overcap for use with the alternative embodiment outer ring unit of FIG. 5. In FIG. 5, safety cap 50 includes an outer ring unit 60 and a top dispenser 70. The main closure base 51 of outer ring unit 50 is shown attachable to any container for which it is designed. This attachment may be a force fit snap on attachment, a locking ratchet mechanism, a lock thread attachment, or any other known attachment mechanism. Base 51 includes a circular recess 53 and an outwardly biased ledge 55. There is a gap that is cut out from ledge 55, shown as gap 57. There is also a ring gap lock 61 positioned in cut out gap 57 that has a first locked position, as shown here. Also, ring gap lock 61 has an arcuate recess under outwardly biased ledge 65 that mimics the same components (recess and ledge) of the outer ring unit 60. There is a second cut out gap 59 that has no lock.

Ring gap lock 61 is movable within cut out gap 57 and it includes combined push tab/alignment indicia 63. In this case, the living hinge is a lateral (horizontal) hinge 67 whereas in the prior embodiment, the hinge was at the base of the lock. When an overcap with three protrusions (FIG. 6 below) is snapped onto ledge 55, it cannot be removed unless two steps are taken—first, the overcap needs to aligned with alignment indicia, and, second, ring gap lock 61 needs to be pushed in. Thus, a user may press at indicia 63 so as to move ledge 65 toward center to an unlock position for overcap release. Two of the three protrusions of the overcap will have open gaps (one with no lock and one with a released lock) and the third will then slip out from the ledge to permit overcap removal.

FIG. 6 shows the overcap 80 with sidewall 81, top 83 and open bottom 93. There are three protrusions 87, 89 and 91 and two will line up with the gaps of outer ring unit 50 of FIG. 5 when the alignment indicia are aligned with one another, as described above.

Figure 7:
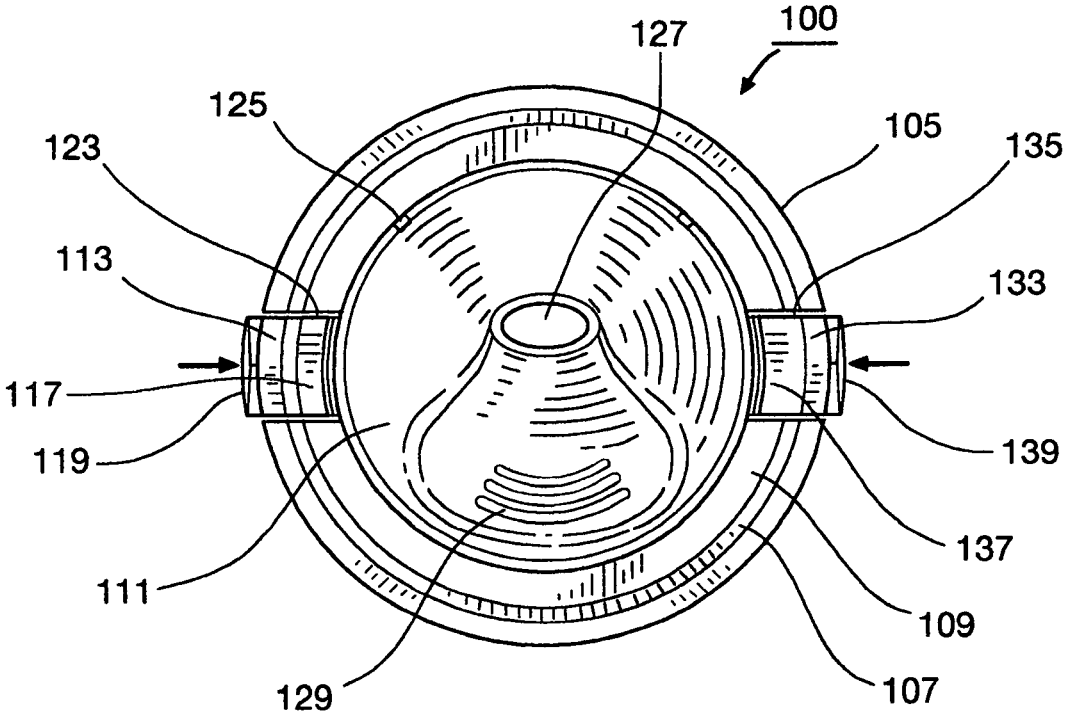
FIG. 7 shows a side oblique view of an alternative embodiment outer ring unit for a present invention child resistant cap outer ring unit with two different cutout gaps, each having a ring gap lock.

FIG. 7 shows a side oblique view of an alternative embodiment safety cap 100 for a present invention child resistant cap outer ring unit with two different cutout gaps, each having a ring gap lock. Safety cap 100 includes an outer ring unit 105 with ledge 109 and bevel 107 and an underneath recess (not shown), as well as a dispenser 111. Dispenser 111 has a dispenser nozzle 127 and a depression actuator 129, as shown, but could instead have any type of dispenser, as mentioned above. Also, gaps 123 and 135 and ring gap locks 113 and 133 are opposite one another, but could be offset so as to have only one open position instead of two, as is the case here. Thus, ring gap locks 113 and 133 sit in gaps 123 and 135 respectively, and are discussed respectively here in parallel. They include indicia 119 and 139, although one indicia would be sufficient. They also include ledges 123 and 137 and are push-in type locks such as is described with respect to FIGS. 1, 2 and 4 above. Dispenser 111 in integrally formed with the ring unit 105, but could be separately cast or otherwise formed without exceeding the scope of the present invention. Here, dispenser 111 is connected to the ring unit 105 by living hinges such as hinge 125. As above, when a snap overcap (two or three protrusion will work here) is in place, the user must (1) align the indicia; (2) depress one or both of the locks (depending on whether the overcap has two or three protrusions); and (3) lift, to access the dispenser.

Top dispenser 21 has an internal connection to the nozzle tube of container 3, which also connects to dispensing nozzle 27. Top dispenser 21 is moveably and hingedly connected to top 7 of ledge 9 at hinge 25. When a user presses grips 29, top dispenser 21 tilts and content is released from container 3 at dispensing nozzle 27. While the dispenser 21 is with a pressurized container and dispenser nozzle, it could alternatively be a push-pull dispenser, a screw cap, a pump dispenser or any other dispenser known. The purpose of the present invention is to create a strong child resistant feature that requires two distinct steps for removal, yet doesn't require significant strength. The two steps are: rotate to align, and release lock to remove overcap.

While the embodiment with three protrusions and two gaps is described above, as well as other embodiments, other combinations of protrusions and gaps and locks are now contemplated, depending upon the widths of the protrusions and the diameter of the ring and on the positioning of the protrusions relative to one another (e.g., evenly spaced apart or not). Table 1 below lists some possibilities (numbers of these components larger than those shown in Table 1 are also within the scope of the present invention:

TABLE 1

Some Component Combination Possibilities

| Overcap Protrusions | Cut Out Gaps | Cut Out Gap Locks |
|---|---|---|
| Two | One | One |
| Two | Two | One |
| Two | Two | Two |
| Three | One | One |
| Three | Two | One |
| Three | Two | Two |
| Three | Three | One |
| Three | Three | Two |

Typically, those embodiments above that have one or more open gaps (no locks) would have varying width protrusions and frictional engagement with the ring unit.

As mentioned, the ring unit may be fixed so as to not rotate relative to the container or may be rotatable on the container and frictionally engaged with the overcap. If fixed, it is a matter of tightness and/or locking of the attachment with the container, such as one-way ratchets, force fit connection, crimping, gluing, heat welding or any other technique used to prevent a container top from rotating. If the outer ring unit is to rotate, then the attachment may be any that allows for rotation, such as a snug but not tight snap-on flange.

Figure 8:
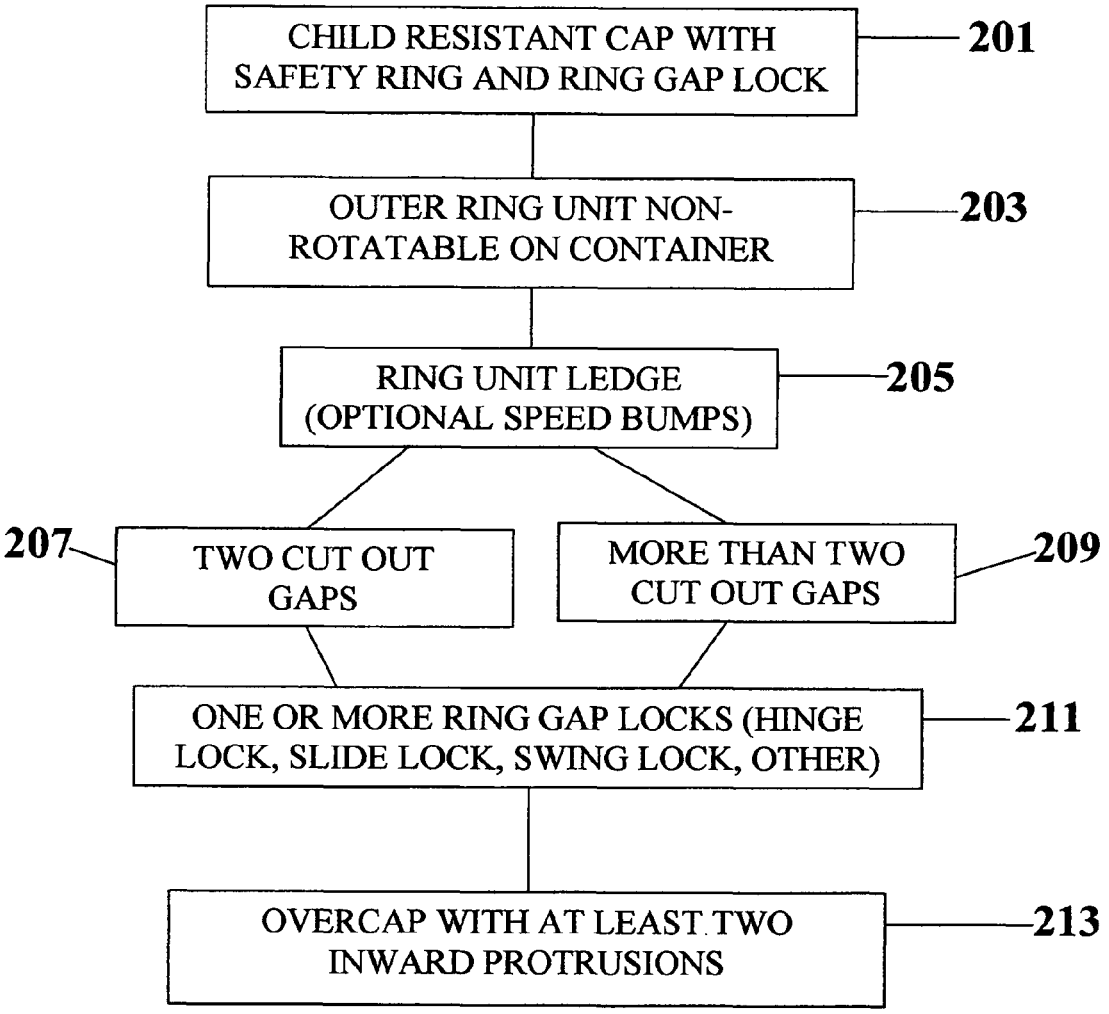
FIG. 8 illustrates a diagrammatic representation of one group of present invention child resistant safety caps wherein the outer ring unit is fixedly attached to a container; and, FIG. 9 illustrates a diagrammatic representation of one group of present invention child resistant safety caps wherein the outer ring unit is movably attached to a container.

FIG. 8 illustrates a diagrammatic representation of one group of present invention child resistant safety caps wherein the outer ring unit is for being fixedly attached to a container. The details are set forth in the frames 201, 203, 205, 207, 209, 211 and 213, respectively.

Figure 9:
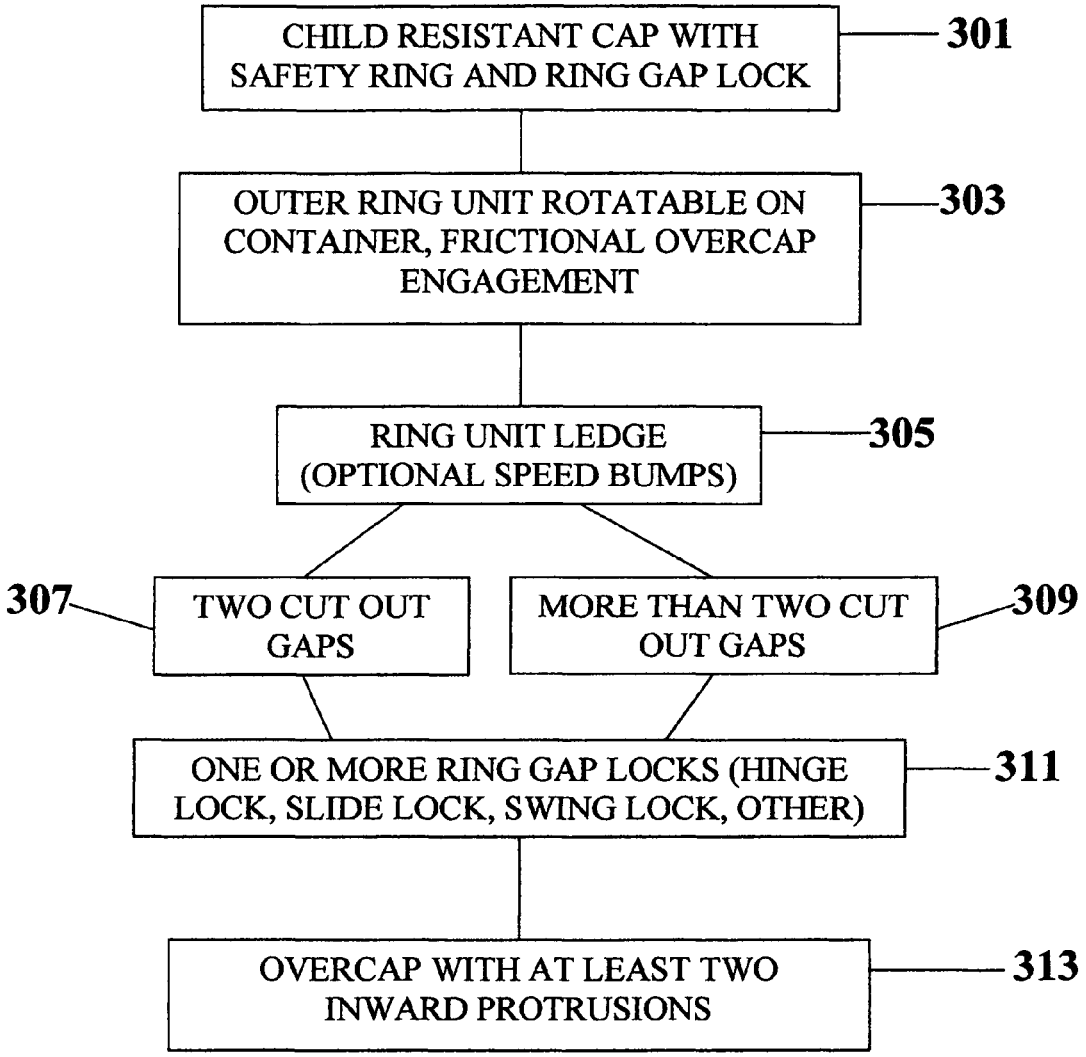

FIG. 9 illustrates a diagrammatic representation of one group of present invention child resistant safety caps wherein the outer ring unit is movably attached to a container. The details are set forth in the frames 301, 303, 305, 307, 309, 311 and 313, respectively.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims. For example, components may reverse the male and female aspects without exceeding the scope of the invention. The overcap may snap into the inside of a ring instead of on its outside with the track of the ring being on an inside surface instead of an outside surface. Also, for example, the protrusions and cut outs could be reversed and located on the ring and overcap, respectively.

What is claimed is:

1. A child resistant cap with safety ring and ring gap lock for direct attachment to a container having a rim of greater diameter than its neck, which comprises:

a) an outer ring unit having a circular inside wall with a horizontal track thereon for attachment to the rim of a container having a top dispenser and having a rim of greater diameter than its adjacent neck, so as to connect said outer ring unit to said rim so as to be horizontally and freely rotatable thereabout, said outer ring unit having a top with an outwardly biased ledge to permit an overcap to be inserted onto and removed from said outer ring unit, and said ledge having at least one cut out gap thereon;

b) at least one moveable ring gap lock located in said at least one cut out gap, said ring gap lock having a first position, being a locked position blocking said at least one cut out gap, and having a second position, being a release position opening said at least one cut out gap and, one of said outer ring unit and said at least one moveable ring gap having a first alignment indicia thereon;

c) an overcap having a circular bottom adapted to be inserted over said top dispenser of said container and onto said outer ring unit, said circular bottom having a second alignment indicia, and said overcap having at least two protrusions thereon, at least one of which has a geometry of adequate size to freely move through said at least one cut out gap when said gap lock is in its release position, and of adequate size and geometry to prevent removal of said overcap from said outer ring when said gap lock is in said locked position;

d) further wherein said outer ring unit ledge has an underside and said at least two protrusions of said overcap has a top, wherein the underside of said ledge and the top of said at least two protrusions are in frictional contact with one another when said overcap is inserted into said outer ring unit such that when one of said outer ring unit and said overcap are rotated, the other of said outer ring unit and said overcap rotates therewith, and wherein said frictional contact may be overcome manually by holding one of said outer ring unit and said overcap and rotating the other of said outer ring unit and said overcap relative to one another; and, wherein when one of said outer ring unit and said overcap is held, and the other of said outer ring unit and said overcap is rotated to place said first alignment indicia and said second alignment indicia in alignment with one another, and then said gap lock is moved into said release position, said overcap may be removed from said outer ring unit to uncover said top dispenser of said container for use.

2. The child resistant cap with safety ring and ring gap lock of claim 1 wherein said at least one cut out gap is a plurality of cut out gaps.

3. The child resistant cap with safety ring and ring gap lock of claim 1 which further includes an interloper attachment means for positioning between said outer ring unit and a container neck to which it is to be attached, and having container attachment means selected from the group consisting of threading, snap-lock and spring lock.

4. The child resistant cap with safety ring and ring gap lock of claim 1 further having at least two speed bumps located below said outwardly biased ledge adapted to reduce for horizontal movement of an overcap until minor frictional engagement is surpassed by minimal force.

5. The child resistant cap with safety ring and ring gap lock of claim 1 wherein said ring gap lock is selected from the group consisting of a slide lock, a hinge lock and a swing lock.

6. The child resistant cap with safety ring and ring gap lock of claim 1 wherein said ring gap lock is a hinged ring gap lock that may be pressed to move it from said locked position to said release position.

7. The child resistant cap with safety ring and ring gap lock of claim 1 wherein there are at least three protrusions, said protrusions being spaced apart from one another.

8. The child resistant cap with safety ring and ring gap lock of claim 1 wherein said underside of said ledge and said top of said at least one protrusion have non-smooth topographies to enhance said frictional contact.

9. The child resistant cap with safety ring and ring gap lock of claim 1 wherein at least one of said ledge and said at least two protrusions are flexible so as to permit insertion of said overcap onto said outer ring without alignment of said at least two protrusions and said at last two one out gap, and are upwardly inflexible so as to prevent removal of said overcap from said outer ring, except when there is alignment and said gap lock is in its release position.

10. The child resistant cap with safety ring and ring gap lock of claim 1 wherein there are two ring gap locks at two different gaps.

11. A child resistant cap with safety ring and ring gap lock for direct attachment to a container having a rim of greater diameter than its neck, which comprises:

a) an outer ring unit having a circular wall with a horizontal track thereon for attachment to the rim of a container having a top dispenser and having a rim of greater diameter than its adjacent neck, so as to connect said outer ring unit to said rim so as to be horizontally fixed thereon, said outer ring unit having a top with an outwardly biased ledge to permit an overcap to be inserted onto and removed from said outer ring unit, and said ledge having at least one cut out gap thereon;

b) at least one moveable ring gap lock located in said at least one cut out gap, said ring gap lock having a first position, being a locked position blocking said at least one cut out gap, and having a second position, being a release position opening said at least one cut out gap and, one of said outer ring unit and said at least one moveable ring gap having a first alignment indicia thereon;

c) an overcap having a circular bottom adapted to be inserted over said top dispenser of said container and onto said outer ring unit, said circular bottom having a second alignment indicia, and said overcap having at least two protrusions thereon, at least one of which has a geometry of adequate size to freely move through said at least one cut out gap when said gap lock is in its release position, and of adequate size and geometry to prevent removal of said overcap from said outer ring when said gap lock is in said locked position;

d) further wherein said outer ring unit ledge has an underside and said at least two protrusions of said overcap have a top, wherein the underside of said ledge prevents the top of said at least two protrusions from passing over said ledge, except when in the gap position when said at least one moveable ring gap lock is moved to said release position to permit at least one of said at least two protrusions to pass therethrough; and, wherein when one of said outer ring unit and said overcap is held, and the other of said outer ring unit and said overcap is rotated to place said first alignment indicia and said second alignment indicia in alignment with one another, and then said gap lock is moved into said release position, said overcap may be removed from said outer ring unit to uncover said top dispenser of said container for use.

12. The child resistant cap with safety ring and ring gap lock of claim 11 wherein said at least one cut out gap is a plurality of cut out gaps.

13. The child resistant cap with safety ring and ring gap lock of claim 11 which further includes an interloper attachment means for positioning between said outer ring unit and a container neck to which it is to be attached, and having container attachment means selected from the group consisting of threading, snap-lock and spring lock.

14. The child resistant cap with safety ring and ring gap lock of claim 11 further having at least two speed bumps located below said outwardly biased ledge adapted to reduce for horizontal movement of an overcap until minor frictional engagement is surpassed by minimal force.

15. The child resistant cap with safety ring and ring gap lock of claim 11 wherein said ring gap lock is selected from the group consisting of a slide lock, a hinge lock and a swing lock.

16. The child resistant cap with safety ring and ring gap lock of claim 11 wherein said ring gap lock is a hinged ring gap lock that may be pressed to move it from said locked position to said release position.

17. The child resistant cap with safety ring and ring gap lock of claim 11 wherein there are at least three protrusions, said protrusions being spaced apart from one another.

18. The child resistant cap with safety ring and ring gap lock of claim 11 wherein said underside of said ledge and said top of said at least one protrusion have non-smooth topographies to enhance said frictional contact.

19. The child resistant cap with safety ring and ring gap lock of claim 11 wherein at least one of said ledge and said at least two protrusions are flexible so as to permit insertion of said overcap onto said outer ring without alignment of said at least two protrusions and said at last two cut out gaps, and are upwardly inflexible so as to prevent removal of said overcap from said outer ring, except when there is alignment and said gap lock is in its release position.

20. The child resistant cap with safety ring and ring gap lock of claim 11 wherein there are two ring gap locks at two different gaps.

* * * * *